United States Patent [19]

Brunfeldt et al.

[11] Patent Number: 4,879,458

[45] Date of Patent: Nov. 7, 1989

[54] AUTOMATIC SAMPLE SYSTEM FOR MASS SPECTROMETER

[75] Inventors: Robert J. Brunfeldt; James C. Jackson, both of Bartlesville, Okla.

[73] Assignee: R. J. Brunfeldt Company, Inc., Bartlesville, Okla.

[21] Appl. No.: 94,018

[22] Filed: Sep. 4, 1987

Related U.S. Application Data

[63] Continuation of Ser. No. 765,835, Aug. 15, 1985.

[51] Int. Cl.[4] ..... H01J 49/04

[52] U.S. Cl. ..... 250/288; 250/281; 250/425

[58] Field of Search ..... 250/281, 288 R, 425, 250/491.1

[56] References Cited

U.S. PATENT DOCUMENTS

| | | | |
|---|---|---|---|
| 2,767,319 | 10/1956 | Beeton et al. | 250/288 |
| 3,590,243 | 6/1971 | Perrin et al. | 250/288 |
| 3,866,041 | 2/1975 | Attia | 250/281 |
| 4,076,982 | 2/1978 | Ritter et al. | 250/288 |
| 4,314,156 | 2/1982 | Kuppermann et al. | 250/281 |
| 4,405,860 | 9/1983 | Brunnee et al. | 250/288 |
| 4,532,816 | 8/1985 | Miller | 250/288 |
| 4,544,317 | 10/1985 | Carter | 250/441.1 |

OTHER PUBLICATIONS

"An Apparatus for Assaying Helium in Constructional Materials", by Dashkovskii et al., Atomnaya Énergiya, vol. 40, #3, Mar. 1976.

*Primary Examiner*—Craig E. Church
*Assistant Examiner*—John C. Freeman
*Attorney, Agent, or Firm*—Head & Johnson

[57] ABSTRACT

An automated sample inlet system for sequentially introducing a plurality of indium encapsulated samples into a mass spectrometer wherein the samples are placed in a micro tube and loaded into a circular carousel under a vacuum bell jar maintained at ambient temperature. The samples are systematically advanced by rotating the carousel resulting in each sample sequentially falling through a delivery tube containing an inverted ball valve into a sample vaporizing chamber within an oven. An additional pair of sapphire ball valves in communication with the glass vaporizing chamber are sequentially opened and closed in a preprogrammed manner along with the opening and closing of the thermal inverted ball valve and the indexing of the carousel such as to automatically evacuate the glass inlet system iwthin the oven, introduce a new sample and vaporize it and then inject this vapor into a mass spectrometer. Such a system is useful in running large numbers of mass spectrometer analyses of hydrocarbon liquids and the like.

1 Claim, 8 Drawing Sheets

AUTOMATIC SAMPLE SYSTEM FOR MASS SPECTROMETER

This is a continuation of co-pending application Ser. No. 765,835, filed on Aug. 15, 1985, now abandoned.

BACKGROUND OF THE INVENTION

1. Field of the Invention:

This invention relates to an automatic sample inlet system for a mass spectrometer or the like. More specifically, the invention relates to an improved sample inlet system for a mass spectrometer wherein a series of samples are sequentially transferred from a room temperature vacuum environment into a sample vaporization oven and subsequently injected into a mass spectrometer which operates on a preprogrammed automated basis.

2. Description of the Prior Art:

The introduction or injection of a small sample of vapors of a high molecular weight compound into various scientific apparatus, equipment, analytical instruments, or the like has historically presented a serious problem. In order to volatilize such a sample, high temperatures and low pressures are required. Such conditions inherently imply heating and cooling with an associated thermal expansion problem as well as sample stability or sample environment compatibility considerations. Thus, in designing and building an acceptable sample inlet system, particularly when the system is to be used repeatedly such as when a series of samples are to be injected into a mass spectrometer, one must account for repeated expansion and contraction of the sample ampoule seal.

One of the earliest designs for a mass spectrometer inlet system which required high temperature vaporization of the sample was a gallium covered glass frit inlet. Later, a gallium orifice inlet was introduced that eliminated the problem of sample fractionation caused by the frit, but had an upper temperature limit of about 300° C. and retained the property of potential catalytic reaction by contact of the sample with hot gallium. Various all glass inlet system have also been described in scientific literature. In one system a weighed sample sealed in a capillary tube is introduced into an expansion vessel and then broken with a magnetic plunger. Another all glass heated mass spectrometer inlet which extends the upper operating temperature from about 300° to 450° C. for very small samples (0.1 milligrams) is disclosed in J. Mass Spectrometry and Ion Physics (1968), pages 87–92 and is the subject matter of U.S. Pat. No. 3,594,574. This inlet system includes a valved manifold and a vacuum lock for sealingly connecting a sample container to the manifold. The lock chamber is formed by two concentric tubes joined at one end by a ring seal and polished to an optical flat mating surface at the other end. A vacuum outlet tube is connected to the annular space or central chamber between the concentric tubes such that the sample ampoule tube with optical flat mating surface can be held against this vacuum lock during operation. This optical flat vacuum lock inlet system has proved to be a reliable method of introducing small samples at higher temperatures without loss of vacuum in the mass spectrometer, yet is limited in that the presence of the concentric tubes create dissimilar rates of thermal expansion upon heating.

In a recent U.S. Pat. No. 4,465,930, a specific improvement in this glass inlet system is disclosed wherein the interface between the two separable polished glass flats is provided with a groove that is substantially surrounded by an essentially continuous matrix of glass and connected to a vacuum source during operation. In this manner, the sample lock exhibits greater stability and more uniform expansion and contraction during heat up or cool down. In principle, it would be ideal to be able to employ such an improved vacuum lock in an automated glass inlet system such that a preprogrammed sequence of samples could be introduced into the mass spectrometer without an operator being continuously present to perform the manipulative steps necessary for injecting individual samples. The present invention is viewed as being such a system.

SUMMARY OF THE INVENTION

In view of the limitations of the prior art, the present invention provides an automated sample inlet system comprising:

(a) a sample holding means adapted to sequentially release a plurality of individual sample ampoules wherein the individual sample ampoule comprises a sample encapsulated in a low melting enclosure;

(b) a vacuum enclosure means adapted to enclose the sample holding means and plurality of individual sample ampoules under vacuum at ambient temperature;

(c) a sample ampoule conduit means in vacuum communication with the vacuum enclosure means and positioned below the plurality of sample ampoules such as to convey the sample ampoules from the vacuum enclosure means at ambient temperature to a sample vaporizing chamber means at an elevated temperature as the individual sample ampoules are sequentially released;

(d) a sample vaporizing chamber means in vacuum communication with the sample ampoule conduit means for sequentially receiving the individual sample ampoules and melting the low melting enclosure, thus releasing the sample and allowing it to vaporize within the sample vaporizing chamber means;

(e) an inverted ball and seat valve means located in the sample ampoule conduit means wherein the sequentially released plurality of individual sample ampoules drop through the inverted ball and seat valve means when the inverted ball and seat valve means is temporarily opened after vacuum evacuation of the sample vaporizing chamber means;

(f) a first valved conduit means in vacuum communication with the sample vaporizing chamber means and a vacuum source for evacuating the sample vaporizing chamber means between the samples being sequentially introduced through the inverted ball and seat valve means; and (g) a second valved conduit means in vacuum communication with the sample vaporization chamber means and a mass spectrometer or other instrument for receiving the sequentially vaporized samples for analysis subsequent to the samples being introduced into and vaporized in the sample vaporizing chamber means.

Furthermore, the present invention provides an improved method and equipment for transferring under vacuum an encapsulated sample from a vacuum reservoir maintained at ambient temperature to a vacuum reservoir maintained at a higher temperature. This specific improvement comprises:

(a) an essentially vertical glass conduit means in vacuum communication between the ambient temperature, vacuum reservoir and the high temperature, vacuum reservoir; and (b) an inverted ball and seat valve means located in the vertical glass conduit such that the ball is lowered to open the valve allowing an encapsulated sample to fall from the ambient temperature, vacuum reservoir to the high temperature, vacuum reservoir and the ball is raised to seal the high temperature, vacuum reservoir from the ambient temperature, vacuum reservoir during release, vaporization and injection of the sample.

The present invention further provides an improved sample holding carousel with a plurality of holes circumferentially displaced around the carousel employed for holding a plurality of encapsulated sample ampoules wherein the specific improvement comprises: a pair of superimposed discs adapted to engage to and rest on the carousel wherein the superimposed discs contain a plurality of circumferentially displaced holes that correspond to and align with the holes in the carousel when engaged to and resting on the carousel and wherein the pair of discs are further adapted to rotationally pivot relative to each other when removed from the carousel such as to misalign the plurality of holes in the discs and prevent individual sample ampoules from falling through the holes thus allowing the pair of discs to be loaded with a plurality of sample ampoules when the discs are removed from the carousel and the holes are misaligned and the entire set of sample ampoules and discs can be loaded onto the carousel in a single operation followed by realignment of the holes in order to load the automatic sample inlet system.

It is an object of the present invention to provide an automatic or automated glass sample inlet system which can be used to inject sequentially a series of encapsulated liquid hydrocarbon samples into a mass spectrometer without requiring an operator to be in attendance during the automated sample injection. It is a further object of the present invention to provide a method and equipment for transferring an encapsulated volatile sample under vacuum from a lower temperature region to a higher temperature region in a manner compatible with the automated injection of samples into a scientific instrument or the like. And it is still a further object of the present invention to provide a convenient method and associated equipment for preparing a series of encapsulated liquid or volatile samples to be used in combination with the improved transfer line and automated sample inlet system. Fulfillment of these objects and the presence and fulfillment of additional objects will become apparent upon a complete reading of the specification and claims when taken in view of the attached drawings.

DESCRIPTION OF THE PREFERRED EMBODIMENTS

Figure 1:
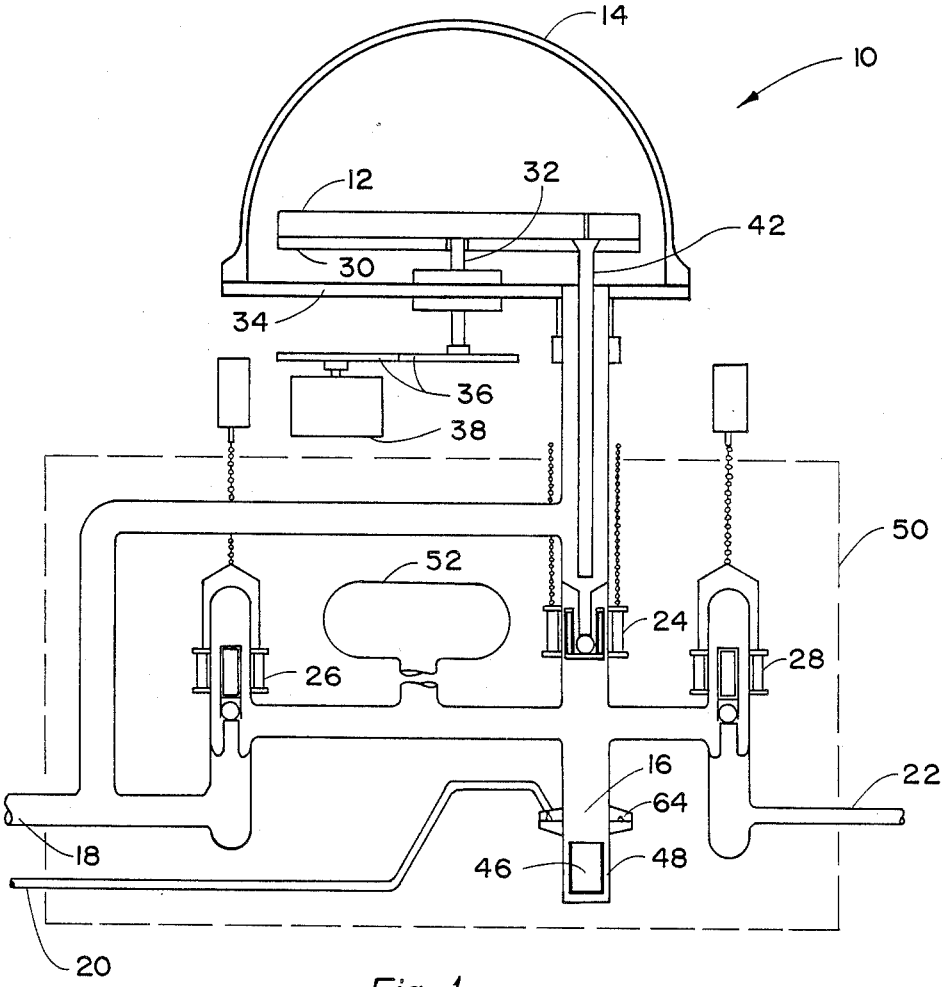
FIG. 1 is a schematic illustration of the overall automatic high temperature/high vacuum inlet system according to the present invention.

The automatic (or automated) sample inlet system according to the present invention, how it operates and the differences and advantages of using the inlet system relative to the prior art devices can perhaps be best explained and understood by reference to the attached drawings. FIG. 1 represents a simplified schematic of the overall inlet system (generally designated by the numeral 10) illustrating the basic interrelationship of the sample holding means 12 enclosed in a room temperature vacuum bell jar 14, the high temperature/high vacuum sample vaporizing chamber and lock 16, the vacuum inlets 18 and 20, sample outlet 22 and associated sapphire ball and seat valves 24, 26 and 28.

Figure 3:
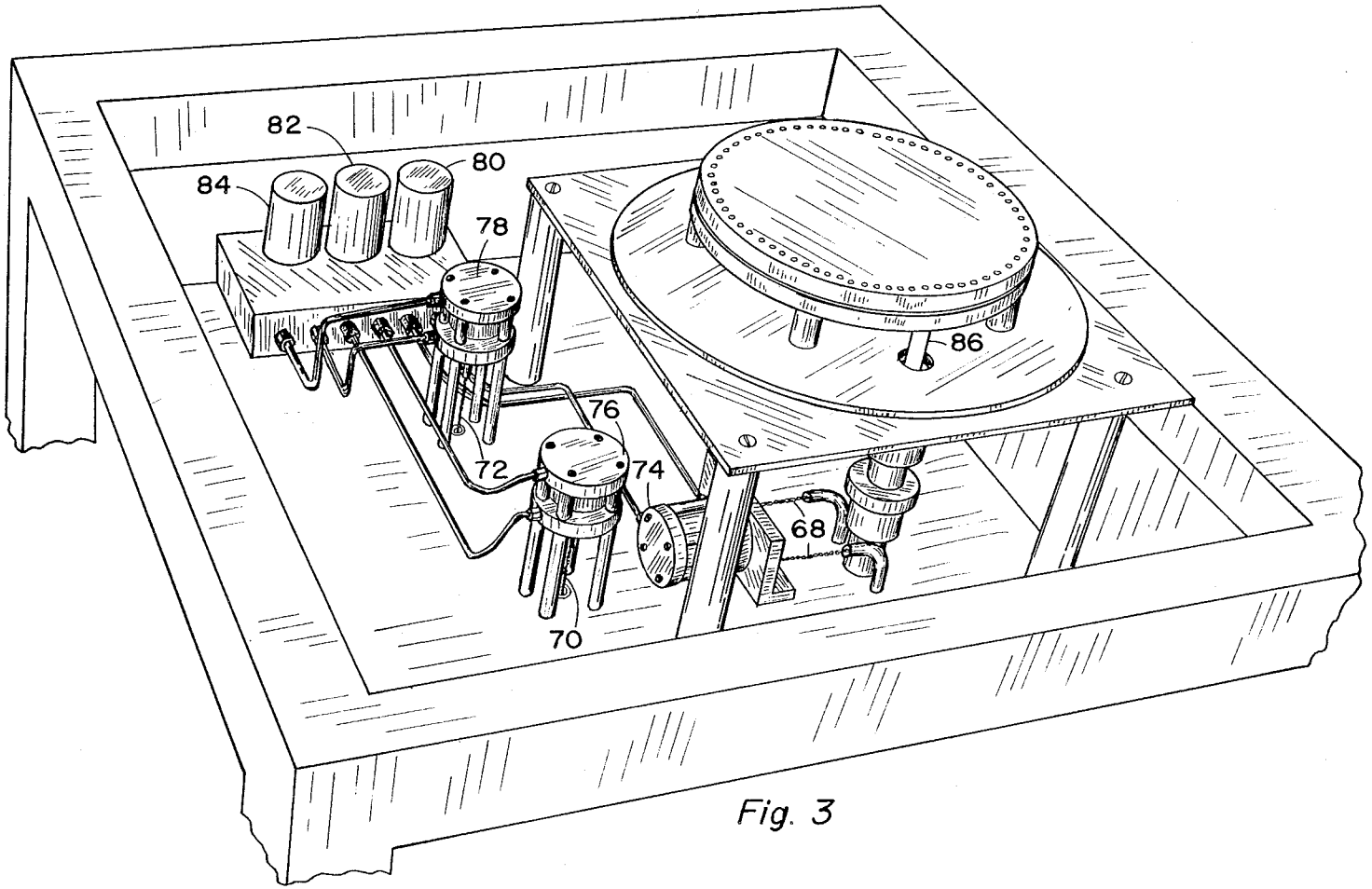
FIG. 3 is a perspective top view of the automatic sample inlet system of FIG. 2.
Figure 4:
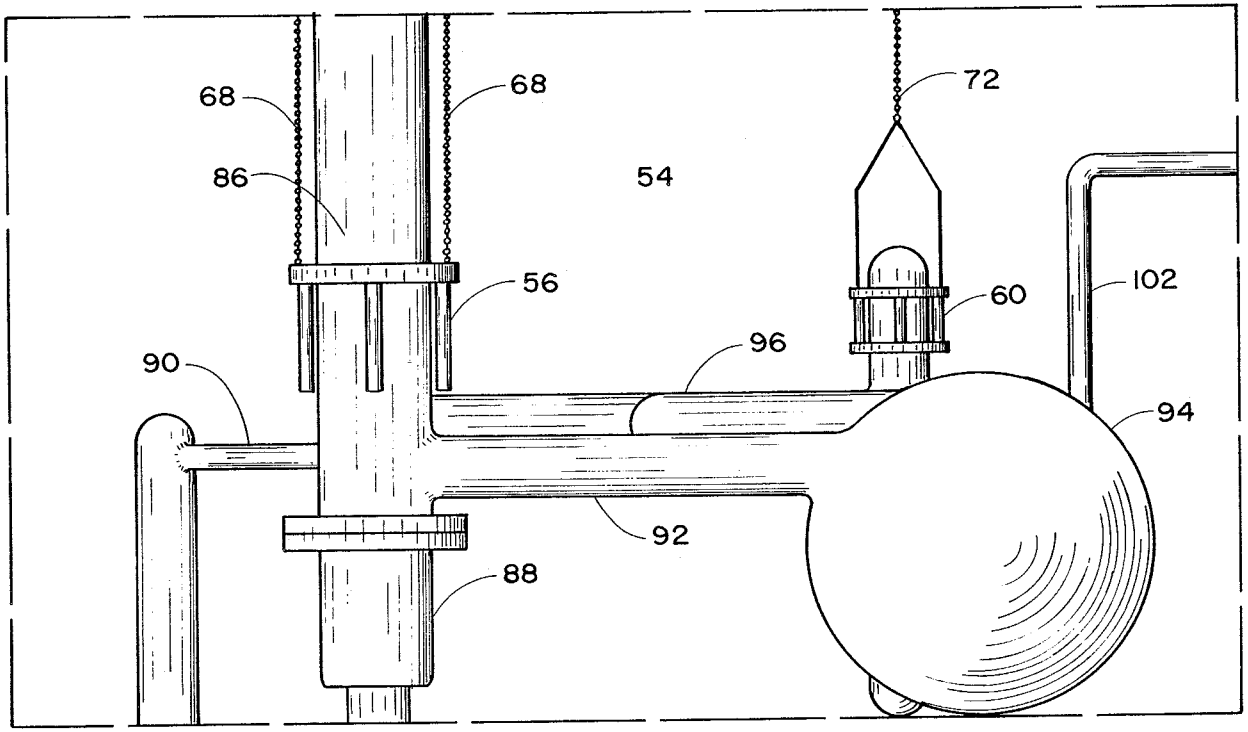
FIG. 4 is a front view of the glassware within the oven of the automatic sample inlet system illustrated in FIG. 2.
Figure 5:
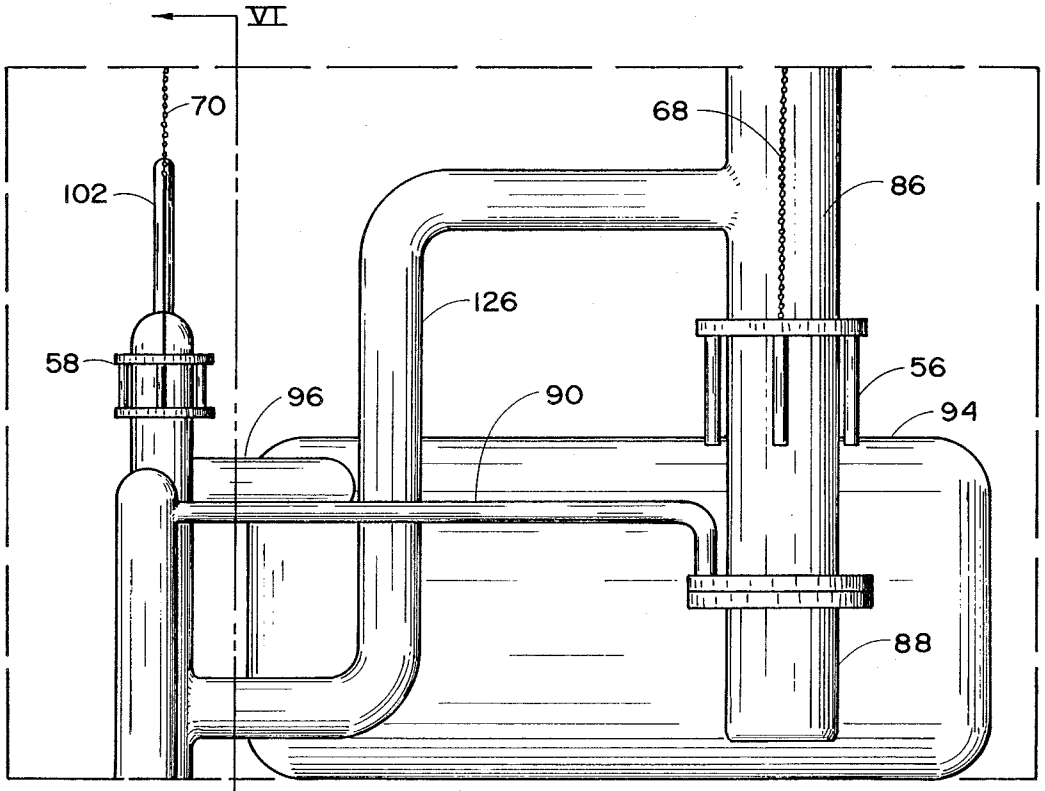
FIG. 5 is a left side view of the glassware within the oven of the automatic sample inlet system of FIG. 2.
Figure 6:
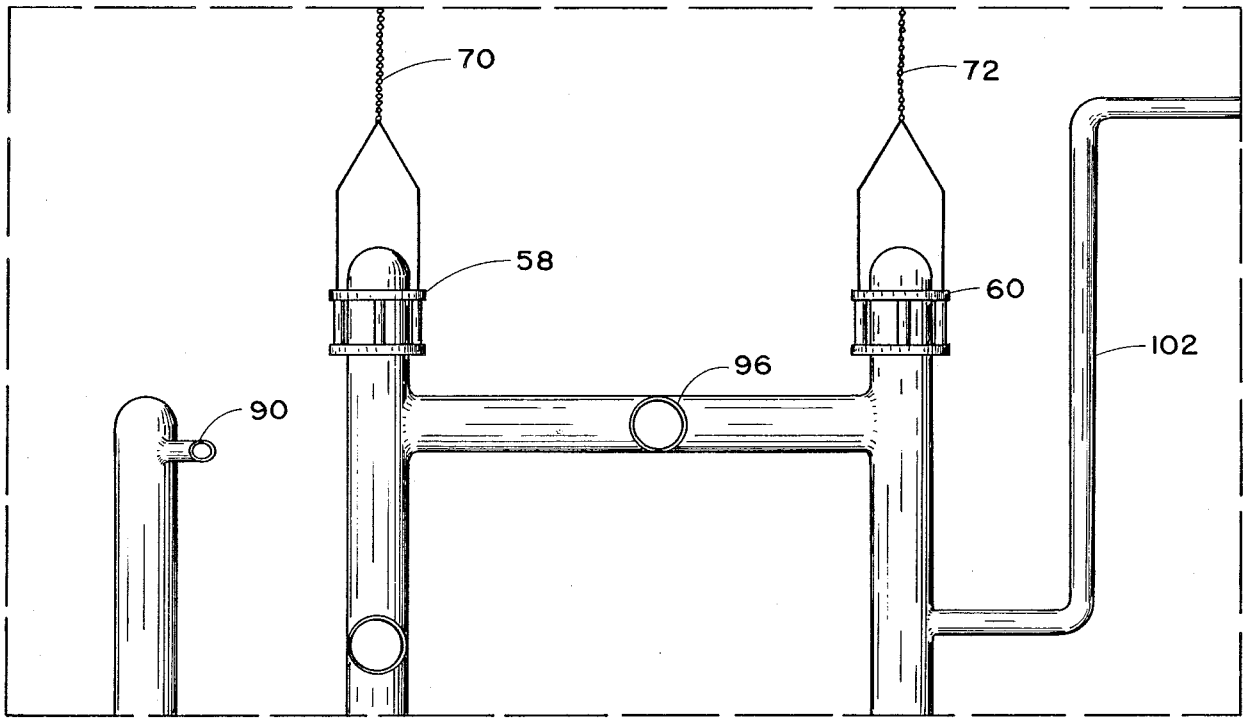
FIG. 6 is a cross-sectional view of the glassware of FIG. 5 as seen through line VI—VI.

As illustrated in FIG. 1, the sample holding means 12 of the automated sample inlet system 10 is, in this specific embodiment, a carousel 30 rotationally mounted on a vacuum sealed axle 32 passing through the center of a base 34 upon which the bell jar 14 rests. The outer end of the axle 32 (under the base) is equipped with a set of meshed indexing gears 36 driven by an indexing motor 38. In this manner, the individual sample ampoules mounted or positioned in a circle of holes in the carousel, see FIG. 3, can be sequentially indexed to a position directly above the funnel shaped sample delivery tube 42 whenever the next sample is to be introduced through the inlet system. When the sample is rotated directly above the tube 42, it falls from the room temperature vacuum bell jar 14 through an inverted ball valve 24 coming to rest in a cup 46 sitting in the bottom of the detachable glass sample receiving vessel 48. The entire region within the dashed line 50 represents an oven maintained at a temperature sufficiently high to melt the low melting metal enclosure confining the sample and to vaporize the confined sample. Since the thermal inverted valve 24 is within the oven and therefore above the melting point of the metal confined in the sample, the sample ampoule is preferably placed in a small glass tube (miniature test tube) such that as the falling sample ampules strikes the ball of the open valve 24, no molten metal will deposit on the ball.

As further illustrated in FIG. 1, within the oven 50 is a glass reservoir 52 connected to the sample receiving vessel 48 between two conventional ball valves 26 and 28, thus forming a sample vaporization and holding chamber. Ball valve 26 isolates the sample vaporization chamber from the high vacuum inlet 18, while ball valve 28 seals the sample vaporization chamber from the sample outlet 22. The high vacuum inlet 18 branches prior to ball valve 26 leading to the top side of the inverted ball valve 24 and then upwards concentrically to tube 42 through base 34 such as to pull a vacuum on the bell jar 14. An intermediate or fore vacuum inlet 20 is also shown connected to a seal ring groove 64 of the polished glass seal on the detachable sample receiving vessel 48. In this manner, any leak across the polished glass seal 64 is evacuated without contaminating the sample. For further details as to such a sealed glass sample reservoir and its use, see U.S. Pat. No. 4,465,930.

The fore vacuum 20 can also be employed at the vacuum inlet (as described and illustrated later) to evacuate the system before employing high vacuum.

During automatic use of the overall sample inlet system of FIG. 1, the ball valves within oven 50 are controlled by pulling on chains external to the oven that lift and lower magnets within the oven. These magnets encircle the exterior of the glass wall of the valve and thus hold the magnetically supported ruby ball within the body of the valve either on or off the valve seat. In preparing for the introduction of the next sample, valves 28 and 24 are closed by lowering the magnet of valve 28 and raising the magnet of valve 24. Valve 26 is then opened by raising the magnet of this valve. This exposes the interior of the sample vaporization chamber (i.e., the reservoir 52 and sample receiver 48) to the high vacuum 18. After evacuation, valve 26 is closed and the magnet of valve 24 is lowered to allow the ball of this inverted valve to drop away from the seat. The carousel 30 is then indexed to the next position by rotating the next sample such that it is directly above the tube 42. This in turn allows the miniature glass test tube containing the metal encapsulated sample to fall through tube 42 striking the ball and deflecting down into cup 46. Valve 24 is then immediately closed by lifting the magnet, forcing the ball against the seat. In this manner, the volatile sample confined by the low melting metal is transferred under vacuum from room temperature to the interior of the hot oven automatically in a very short time span.

By repeating this process, the individual sample ampoules mounted or positioned in a circle of holes in the carousel can be sequentially indexed to a position directly above the funnel-shaped sample delivery tube 42 whenever another sample is to be introduced through the inlet system. As a new sample is rotated directly above the tube 42, the sample falls from the room temperature vacuum bell jar, through an inverted ball valve 24 coming to rest in a cup 46 resting in the bottom of a detachable glass sample receiving vessel 48. The entire region within the dashed line 50 represents an oven maintained at a temperature sufficiently high to melt the low melting metal ampoule confining the sample and to vaporize the confined sample. Since the thermal inverted valve 24 is within the oven and therefore, above the melting point of the metal confining the sample, the sample ampoule is preferably placed in a small glass tube (miniature test tube) such that as the falling sample ampoule strikes the ball of open valve 24, no molten metal will deposit on the ball.

FIGS. 2 through 8 illustrate one particularly preferred embodiment of the present invention. As illustrated in the front view of FIG. 2, the automated inlet system involves an insulated oven 54 with internal glassware and magnetic operated ball valves 56 and 60 centrally positioned with a control panel 62 below and a carousel sample holder 64 with actuating mechanism and indexing motor 66 on top of the oven 54. As further illustrated in FIG. 3, the ball valve actuating mechanisms are preferably chain operated mechanical systems 68, 70 and 72 for lifting and lowering the magnets (see FIGS. 4, 5 and 6). The chains 68, 70 and 72 in turn are activated by pneumatic cylinders 74, 76 and 78 (see FIG. 3) that are turned on and off by electrically actuated solenoid valves 80, 82 and 84 (wiring not shown). In this manner, the smooth activation of the pneumatic cylinders 74, 76 and 78 insures gentle lifting and lowering of the ruby or sapphire ball on and off of the glass seat of the valve. Thus, the mechanical stroke of the magnet is controlled and banging of the sapphire ball on the seat of the valve is prevented, yet the reliability and convenience of an electrical solenoid is still present. As such, the specific embodiment presented in these figures can be readily employed and interfaced with either a manual and/or computer controlled sample selection system (not shown). Thus, it is envisioned that a microprocessor controlled circuitry interfacing with a mass spectrometer can be readily adapted to the control system of the automated glass inlet system of the present invention.

It should be appreciated that other mechanical, pneumatic, hydraulic and electrical configurations, including combination systems, as generally known in the art can be employed to actuate the various valves within the glass inlet oven of the present invention. As such, these alternatives should be considered equivalent, for purposes of this invention, to the specific preferred embodiment disclosed in the figures and discussed above.

As illustrated in FIGS. 2 through 6, the centrally located oven 54 containing the three sapphire ball valves 56, 58 and 60 and other glassware of the high temperature portion of the automatic inlet system is located directly below the carousel 65 and stepping motor 66 and is interconnected with the sample holding apparatus by the glass sample drop tube 86. As further illustrated, the glass sample drop the 86 containing the inverted thermal valve 56 terminates at the bottom of the tube in a glass cup 88 with polished flats that can be removed from the other glassware. Within the glass cup is a throw-away glass liner (not shown) which collects the remnants of the molten metal and spent glass vials after the release and evaporization of the samples.

After a run (up to forty-seven samples), the system can be cooled and vented to atmosphere and the glass flats separated such as to allow the operator to remove the liner and spent sample ampules. The small glass tube 90 attached to the circumferential ring (see FIG. 5) within the polished flats is connected to the fore vacuum, thus preventing any contamination of the sample associated with leaks across the optically polished flats. The larger glass tube 92 from the sample cup leads to a large sample reservoir 94 that during use will store the vaporized sample to be introduced into the mass spectrometer. The glass exit tube 96 from the large sample reservoir 94 branches to either of the two ball valves 58 and 60 (see FIGS. 5 and 6). In this manner, the contents of the reservoir 94 can either be delivered to the mass spectrometer through valve 60 during sample injection or pumped out of the glass inlet system through the other valve 58 by the high-vacuum pump after sample injection and before introduction of the next sequential sample.

Figure 2:
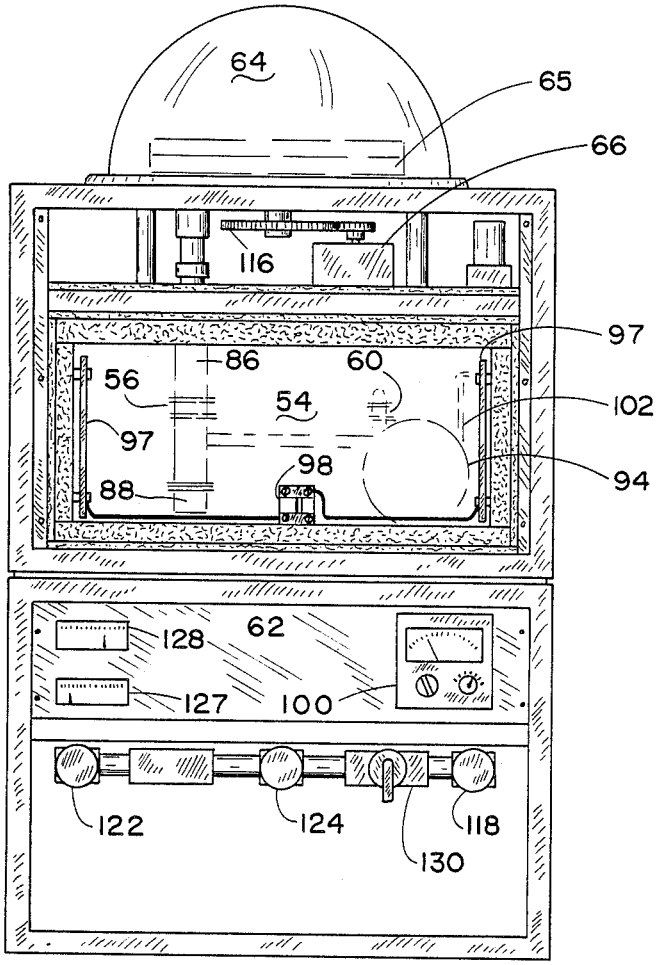
FIG. 2 is a front plan view of one particular embodiment of the automatic sample inlet system according to the present invention that operates according to the schematic of FIG. 1.

As further illustrated in FIG. 2, the insulated oven 54 is heated by a series of strip heaters 97. In order to protect the glassware from melting because of overheating, a thermal fuse 98 is provided within the oven. By passing the electrical current directed to the heaters 97 through a low melting wire or rod 98 placed within the oven 54, the glassware can be protected from overheating associated with a temperature controller 100 malfunction or the like. This is achieved by virtue of the thermal fuse 98 melting, cutting off the current directed to the heaters 97. In practice, a short piece of zinc welding rod with a melting point of about 410° C. is preferably employed as the thermal fuse; however, it should be appreciated that other low melting conductive strips, thermal fuses, thermal circuit breakers and the like as generally known in the art can be used to protect the glassware from overheating. Similarly, various types of insulation as generally known in the art can be employed within the oven. One particular preferred insulation is a product sold under the name WRPX Ceramic Insulator by Refractory Products of Elgin, Ill.

A temperature controller 100 is also to be used to maintain the desired temperature within the oven (e.g., approximately 350° C.). The temperature of the glass exit line 102 from the sample reservoir to the mass spectrometer should also be controlled. Preferably, a separate temperature controller proportioning electrical energy to a heating wire wrapped around the transfer line to the mass spectrometer is to be employed.

Figure 7:
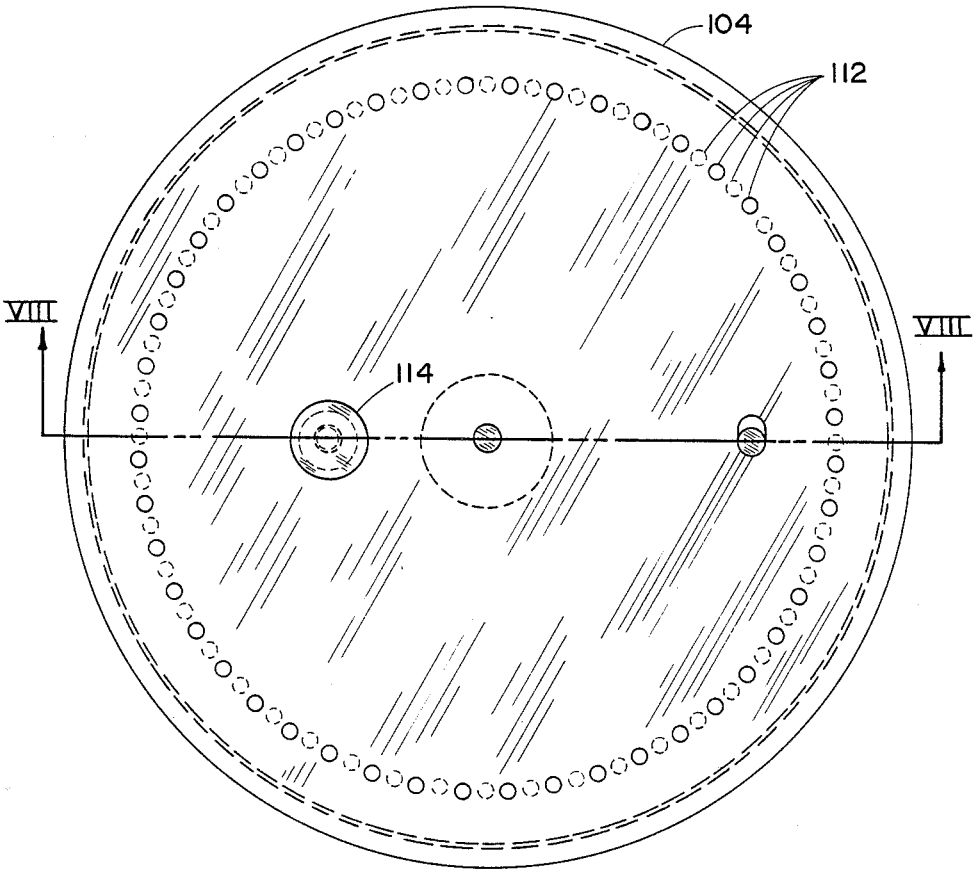
FIG. 7 is a top plan view of the sample holder carousel of the automatic sample inlet system illustrated in FIG. 2.
Figure 8:
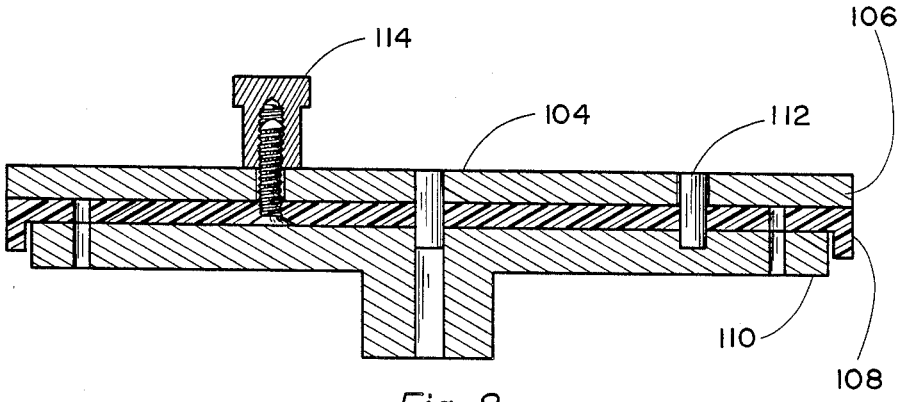
FIG. 8 is a cross-sectional view of the carousel of FIG. 7 as seen through line VIII—VIII.
Figure 9:
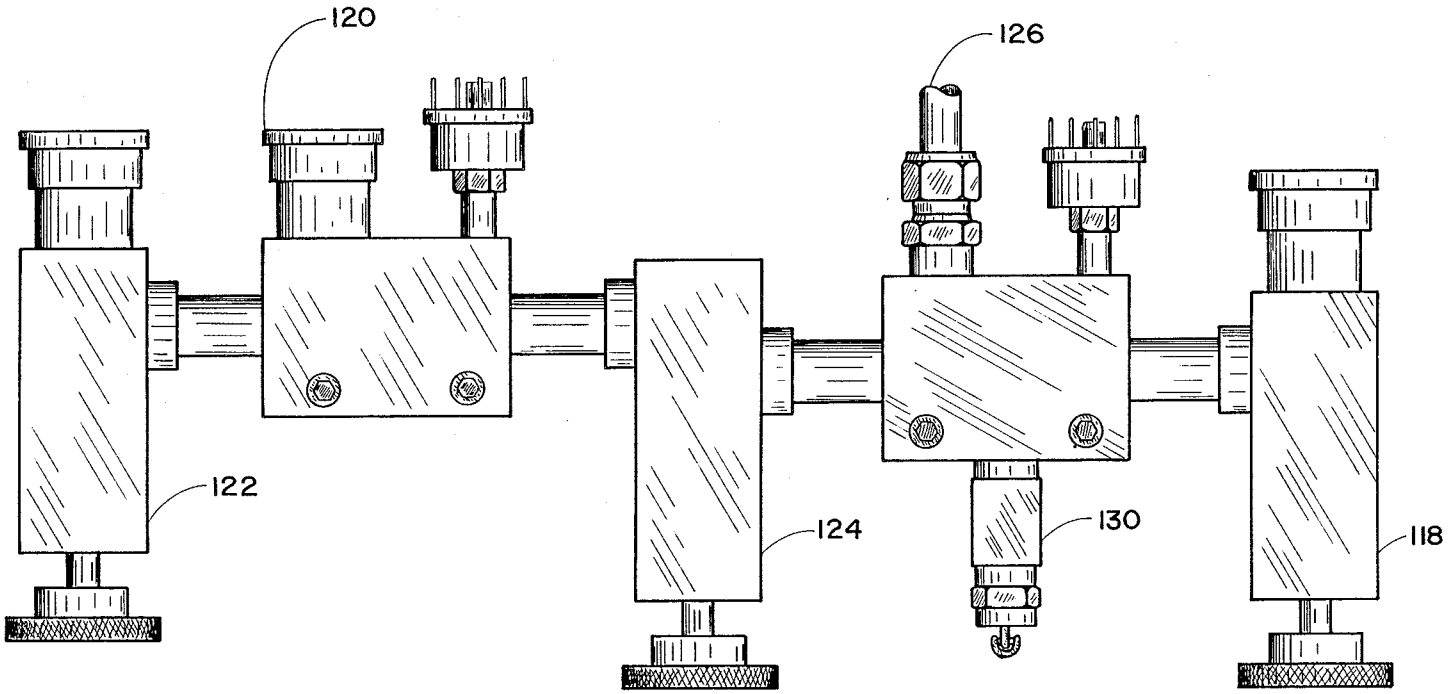
FIG. 9 is a top plan view of the manual valved manifold of the automatic sample inlet system of FIG. 2.

As illustrated in FIGS. 7 and 8, the sample holder carousel 104 is preferably assembled out of three individual disc elements 106, 108 and 110 superimposed upon each other during use. Each of these discs comprises a circular plate with (in this specific embodiment) forty-eight separate holes 112 drilled in a circular pattern around the outer perimeter of the disc. Each hole is sized such as to hold an individual glass micro tube (not shown) containing the indium encapsulated sample in essentially a vertical configuration. The reason for three separate discs with forty-eight holes is to allow for convenient loading of the inlet system at the workbench or laboratory table rather than directly on top of the instrument. This is achieved by virtue of a top rotator plate 106 and intermediate locator plate 108 being removable from the third disc 110 and subassembly of the carousel. In other words, the top two plates 106 and 108 can be physically removed from the inlet system and placed on the workbench. A thumb screw or knob 114 can then be backed off allowing the relative rotation of the rotator plate 106 to locator plate 108 through an angle of about three and one-quarter degrees, thus intentionally misaligning the respective sets of forty-eight holes. In this misaligned configuration, the knob 114 can be retightened and forty-seven of the holes 112 in the rotator plate can be filled with individual glass micro tubes containing sample ampoules without the sample falling through the hole in the locator plate. After filling the entire disc or that portion of the disc to be used in the next sequence of injections into the mass spectrometer, the combination of the two top plates and respective set of samples can be placed back into the inlet system on the carousel inlet sample plate in a single operation. Loosening of knob 114 and rotating plate 106 back three and a quarter degrees will realign all forty-eight holes in all plates. As the holes realign, the operator will see all glass tubes drop slightly through the locator plate 108 and into inlet sample plate 110. The loader is then removed from sample plate 110. The knob 114 can then be retightened and the bell jar placed over the entire assembly for the start of the overall sample injection sequence.

Preferably, the discs are fabricated out of a lightweight metal such as aluminum or impact resistant structural plastic with either a teflon insert of coating or its equivalent between the lower sample inlet plate disc and substructure of the carousel. In this manner, the glass tubes and discs will slide over a relatively friction free surface as the indexing samples approach the sample inlet opening.

The actual indexing of the disc with sample is accomplished in this particular embodiment, by an indexing motor 66 and set of step-down gears 116 attached to the axle that turns the carousel and discs. Since the motor and gears are below the carousel base plate and bell jar, a vacuum seal must be maintained around the shaft of the axle as it rotates. Preferably a ferrofluid seal with seal bearings is employed Also as illustrated, the gearing of the indexing motor involves a step-down of the rotational motion to smooth out the index impulses and advance the glass tubes with sample ampoules in a non-destructive smooth motion. In the illustrated embodiment, a forty-eight position indexing motor was employed with a two to one gear ratio, thus requiring two separate indexing signals to the motor between sample introductions. Two pulses each creating $3\frac{1}{4}$° C. rotation to achieve a total annular displacement of $7\frac{1}{2}$° C. has been found to be consistent with the desired relatively smooth advancement of the carousel.

The actual sample employed in the mass spectrometer glass inlet system according to the present invention is preferably sealed or encapsulated in a low melting metal such as for example, but not limited thereto, indium, lead, or the like. Preferably, an indium capillary tube (mp=156° C.) is employed wherein the tube is filled by capillary action in the case of a liquid and then cut to a predetermined length with each end being crimped. In this manner, the actual quantity of samples sealed within the low melting metal capillary tube will not vary significantly from sample to sample. Thus, the present invention lends itself to highly reproducible sample aliquots As previously mentioned, the indium capillary tube is then preferably placed in a glass micro test tube such that the low melting indium will not deposit on the sapphire ball valve as the sample drops from the room temperature carousel to the inverted valve and into the oven. This particular feature of the invention is felt to be novel in that the use of an inverted ball valve solves the critical problem of transferring an encapsulated sample from a low temperature vacuum chamber (the bell jar) to a high temperature vacuum chamber (the oven).

Using the following commercially available components, an automated inlet system as illustrated in FIGS. 2 through 9 was manufactured. The inlet system was successfully tested on a commercially available mass spectrometer and was found to perform essentially as described.

| | |
|---|---|
| Power supply | GS Sola Electric; 24 v, 6 A, Model No. 83-24-260-3 |
| Pneumatic valves | Humphrey MINI-MYTE in-line valves (0 to 100 psi) Model MC41E1, 85 w, 24 vdc |
| Pneumatic cylinders | BIMBA Flat-1; Bore $\frac{3}{4}$, #10-32, length $\frac{3}{8}$ |
| Magnets | CAST HYFLUX; Ainico 5 Magnets, Stock No. 40003AX, Stock No. 400012A and Stock No. 40045A |
| Ball | Synthetic Sapphire (Ruby); Ball Grade 25, 99.99% $Al_2O_3$ |
| Stepping motor | SLO-SYN; Translator Module, Type STM101 (MP 70-1A-A3-1A; 24 vdc) |
| Motor shaft seal | FERROFLUIDICS; Part No, 50C103236 |
| Heaters | Watlow; Strip Heater Code No. S2J65VI 8418, V 120, W 225, Type M |

During operation of this automatic inlet system, only four functions must be controlled. First, the step motor must receive a signal which results in the motor indexing the carousel, thus causing the next sample to be positioned over the drop tube entering the vaporizing oven. This signal must be timed to follow high evacuation (e.g., $10^{-6}$ Torr.) of the sample evaporating chamber and associated glassware and after opening of the thermal valve which allows the sample to enter the vaporization oven. In the particular embodiment illustrated in FIGS. 2 through 9, the indexing signal involves a pair of pulses producing the overall 7½° C. rotation of the carousel.

The other three functions to be controlled are the three solenoid valves 80, 82 and 84 which control the pneumatic cylinders 74, 76 and 78 which lift and lower the magnets 56, 58 and 60 for opening and closing the three sapphire ball valves within the evaporization oven. One ball valve 58 is connected to the high vacuum pump line for evacuating the sample chamber, the second valve 60 is connected to the mass spectrometer line 102 for delivering the vaporized sample to the mass spectrometer and the third 56 is at the bottom of the drop tube from the carousel for introduction of sample ampoule to the oven. The actual method and equipment to be employed to control and coordinate the respective operations can vary from a totally manual system to a microprocessed unit as generally known in the art. Preferably, a fully automatic, programmable unit is to be used.

A manual valving manifold (see FIGS. 2 and 9) for controlling the two vacuum sources is also provided, but once the high vacuum is achieved the sample injection process continues without further control via the manifold. More specifically, a high vacuum turbo pump runs continuously and is isolated from the inlet with a high-vacuum mechanical valve 118 when required. Likewise, the fore-vacuum source 120 (usually from the mass spectrometer) is isolated by the fore-vacuum mechanical valve 122 of the valving manifold when required. Also, a cross-over valve 124 connects the two vacuum systems with the inlet 126. Thus, both fore-vacuum 122 and high-vacuum valves 118 are closed and the cross-over valve 124 opened when the system is vented.

To begin the overall operation, samples are loaded into indium tubes, preferably using the cutter/crimping tool as previously described. These tubes are placed in small glass vials in the loader. The loader is placed on the carousel and rotated to position the vials in the carousel. The loader is then removed from the carousel and the bell jar is now placed over the carousel. In this vented position, power is shut off to all of the solenoid valves, thus keeping the tube glass valves in the vaporization oven closed.

To begin the vacuum pump down procedure, the crossover valve 124 in the vacuum manifold is opened. The high vacuum solenoid valve 82 is energized to open the glass valve 58. The optical flats and vacuum lock and residual cups should be checked to make sure they are in good contact. The mechanical fore-vacuum valve 122 is then opened, thus allowing a fore-vacuum to be pulled on the entire glass system, both the lower oven glassware and the bell jar. As soon as an acceptable pressure is reached, as indicated on the vacuum gauge 127, the cross-over valve 124 is closed and the high-vacuum mechanical valve 118 is opened. Keeping the mechanical fore-vacuum valve open will allow a fore-vacuum to be continuously pumped on the vacuum ring at the interface of the optical flats. Again, the pressure should be monitored by observing the vacuum gauge 128 to see when it has bottomed. The oven door can then be installed and closed and the heater to the oven and transfer line turned on, thus bringing the entire unit up to the desired temperature as controlled by thermal controllers 100 on the lower panel.

To proceed, a signal from the mass spectrometer indicating that it is ready for the introduction of the first sample is received and in response, the solenoid valve to the high-vacuum glass valve 58 is de-energized, allowing the valve to close. Power is then supplied to the thermal valve solenoid 80, causing it to open at the same time that the indexing motor receives a pair of pulses. These pulses cause the carousel to index one full 7½ degree step. This in turn positions a sample over the drop tube 86 which results in the sample falling into the vaporizing oven 54 through the open thermal valve 56. At a timed interval (approximately 2 seconds or less), after the thermal valve 56 is opened, the thermal valve solenoid 80 is de-energized allowing the valve to close. The function of this valve is to separate the hot vaporizing oven from the cool area above where the samples are located. Due to the manifold design and specifically tube 126, the upper chamber (the bell jar) is pumped by the high-vacuum system continuously, thus providing no pressure gradient across the valve. When the sample is vaporized, there is a higher pressure in the sample reservoir 94, thus tending to close the valve 56 even tighter. Thus, none of the vaporized samples is allowed to travel up the drop tube to a cooler zone to condense. Any valve leakage is immediately pumped away by the high vacuum connection 126 in the oven directly above the thermal valve.

With the sample now in the oven, a period of approximately two minutes is allowed to give the indium time to melt and the sample to vaporize. At the end of this time period, the mass spectrometer valve solenoid 84 is energized to allow the sample to enter the mass spectrometer through the glass valve 60 and heated transfer line 102. As an alternate operation method, this valve could remain open continuously, thus allowing the mass spectrometer scan to begin as soon as vaporization occurs. Sample feed to the mass spectrometer will continue as long as the spectrometer valve remains open. When the mass spectrometer scan is over, a signal from the mass spectrometer will cause the solenoid for the mass spectrometer valve to deenergize and close the valve. Again, the alternate method of operation would allow this valve to remain open. The high-vacuum valve solenoid 82 is then energized to open and pump out the remaining sample. Experience indicates that this takes approximately two minutes. As an alternative method of monitoring the evacuation, the vacuum gauge could be monitored to control the actual time required for evacuation.

As soon as the pump out is completed, the high-vacuum valve solenoid is de-energized, allowing this valve to close. A new signal to the thermal valve solenoid and stepping motor begins the next sample run. This procedure continues until all samples in the carousel have been introduced into the mass spectrometer. The length of time for a complete run depends on the scan time per sample. After introducing a full carousel of samples into the mass spectrometer, the mass spectrometer stops signalling the inlet to continue another cycle. At this point in time, a new set of samples can be introduced into the carousel or the system can be vented to atmosphere for withdrawal of the spent sample ampules.

To vent the inlet, it is necessary to have the solenoids de-energized. This assures that the glass valve to the mass spectrometer is closed and prevents air from entering the mass spectrometer source. The heaters to the evaporization oven can then be turned off and the front door removed to allow the oven to cool. As soon as the residue cup has cooled sufficiently to be held in the operator's hand, the metal high-vacuum and fore-vacuum mechanical valves are closed, the cross-over valve opened and the toggle vent valve 130 open to air. In this manner, the entire system returns to ambient pressure, thus allowing the residue cup to be manually removed. Cooling of the oven before venting assures the indium is solidified and will not contaminate the optical flats when removed from the residue cup. The old glass liner with spent indium and glass tubes can then be replaced with a new glass liner and the polished flats of the residue cup can then be repositioned for the next run. Removal of the bell jar and preparation of the next set of sample ampoules essentially completes the cycle and starts the next run.

Experience indicates that a system similar to that described above will allow for a minimum of two complete carousel loads (approximately ninety-four samples) per day unattended. Again, this depends on the scan time per sample and the operator's ability to prepare this many samples. Savings to be realized in terms of reduced operator time and increased utilization of the mass spectrometer can roughly be equated to one to one and a half man days per day relative to previously known manual injection systems.

Thus, the advantages of the automatic inlet system according to the present invention are considered significant and numerous. First and foremost, there is a savings in terms of reduced manpower and usually an increase in the number of samples being run through a given mass spectrometer because the system can be operated automatically and unattended. Further, the use of the low melting indium capillary tube cut to a prescribed length as the sample holder according to the present invention results in a highly reproducible and controllable sample size. This in combination with the automatic features of the device, essentially eliminates operator technique as a variable in the overall process. All samples will be essentially of one predetermined size, will hit the hot zone of the oven in the same manner, and will experience the same resonance time in the inlet oven, thus leading to more reproducible and consistent analysis. The fact that the overall system can be microprocessor controlled further affords the opportunity to interface the mass spectrometer and the inlet system to other equipment and computer controlled data acquisition and the like.

Having thus described the preferred embodiments with a certain degree of particularity, it is manifest that many changes can be made in the details of the invention without departing from the spirit and scope of the invention. Therefore, it is to be understood that the invention is not limited to the embodiments set forth herein for purposes of exemplification, but is to be limited only by the scope of the attached claims, including a full range of equivalents to which each element thereof is entitled.

What is claimed:

1. An automated sample inlet system to a mass spectrometer (MS) comprising:

(a) holder means for retaining a plurality of sample ampules and sequentially releasing individual sample ampules to drop by gravity, each of said individual sample ampules comprising a low melting enclosure containing a volatile sample;

(b) a sealed enclosure surrounding said holder means with means to maintain said sealed enclosure under substantially constant vacuum at ambient temperature;

(c) a vaporizing chamber within a heated oven, means within said vaporizing chamber for sequentially receiving said individual sample ampule, for melting said low melting enclosure, and thus releasing said volatile sample within said vaporizing chamber and producing a vaporized sample, said vaporizing chamber having a first valve means to sequentially release said vaporized sample to said MS and a second valve means to sequentially evacuate said vaporizing chamber;

(d) a conduit means having one end in vacuum communication with said sealed enclosure with the other end of said conduit means within said heated oven in sealed communication with said vaporizing chamber, said conduit means positioned to convey said released individual sample ampoule from said sealed enclosure to said vaporizing chamber;

(e) an inverted ball and seat valve means located in that portion of said conduit within said heated oven to: (i) control the entry of said sample ampule from said sealed enclosure to said vaporizing chamber after said evacuation of said vaporizing chamber, and thereafter isolate said sample ampule within said vaporizing chamber.

* * * * *